US005945974A

United States Patent [19]

Sharma et al.

[11] Patent Number: 5,945,974

[45] Date of Patent: Aug. 31, 1999

[54] DISPLAY CONTROLLER WITH INTEGRATED HALF FRAME BUFFER AND SYSTEMS AND METHODS USING THE SAME

[75] Inventors: Sudhir Sharma, Plano; G.R. Mohan Rao, Dallas; Michael E. Runas, McKinney, all of Tex.

[73] Assignee: Cirrus Logic, Inc., Fremont, Calif.

[21] Appl. No.: 08/645,021

[22] Filed: May 15, 1996

[51] Int. Cl.[6] ..... G09G 3/36

[52] U.S. Cl. ..... 345/115; 345/113; 345/511; 345/519; 345/526

[58] Field of Search ..... 345/103, 113, 345/115, 132, 508, 511, 519, 520, 521, 526

[56] References Cited

U.S. PATENT DOCUMENTS

| | | | |
|---|---|---|---|
| 4,710,762 | 12/1987 | Yamada | 345/507 |
| 4,897,801 | 1/1990 | Kazama et al. | 345/520 |
| 5,309,168 | 5/1994 | Itoh et al. | 345/3 |
| 5,387,923 | 2/1995 | Mattison et al. | 345/103 |
| 5,422,654 | 6/1995 | Tjandrasuwitu | 345/103 |
| 5,488,385 | 1/1996 | Singhal et al. | 345/3 |
| 5,499,120 | 3/1996 | Hansen | 359/48 |
| 5,537,128 | 7/1996 | Keene et al. | 345/89 |
| 5,572,655 | 11/1996 | Tuljpurkar et al. | 395/788 |
| 5,617,113 | 4/1997 | Prince | 345/103 |
| 5,673,422 | 9/1997 | Kawai et al. | 395/519 |
| 5,724,063 | 3/1998 | Chee et al. | 345/1 |

FOREIGN PATENT DOCUMENTS

| | | | |
|---|---|---|---|
| 0206178 | 6/1986 | European Pat. Off. | G09G 3/36 |
| 0471275 | 2/1992 | European Pat. Off. | G09G 3/36 |
| 2674361 | 3/1991 | France | G06G 3/36 |
| 2255668 | 11/1992 | United Kingdom | G09G 3/36 |

*Primary Examiner*—Mark R. Powell
*Assistant Examiner*—Vincent E. Kovalick
*Attorney, Agent, or Firm*—James J. Murphy; Steven S. Shaw

[57] ABSTRACT

A display controller 104 for use with a display device 107 operable to display images on a screen. Display controller 104 includes circuitry 201–210 for presenting first data to the display device 107 for generating an image in a first areas of the screen, the first data being retrieved from an external frame buffer 108. A display controller 104 further includes circuitry 205, 210 for presenting second data to the display device 107 for generating an image in the second area of the screen, the second data being retrieved from an internal frame buffer 206.

3 Claims, 2 Drawing Sheets

FIG. 3
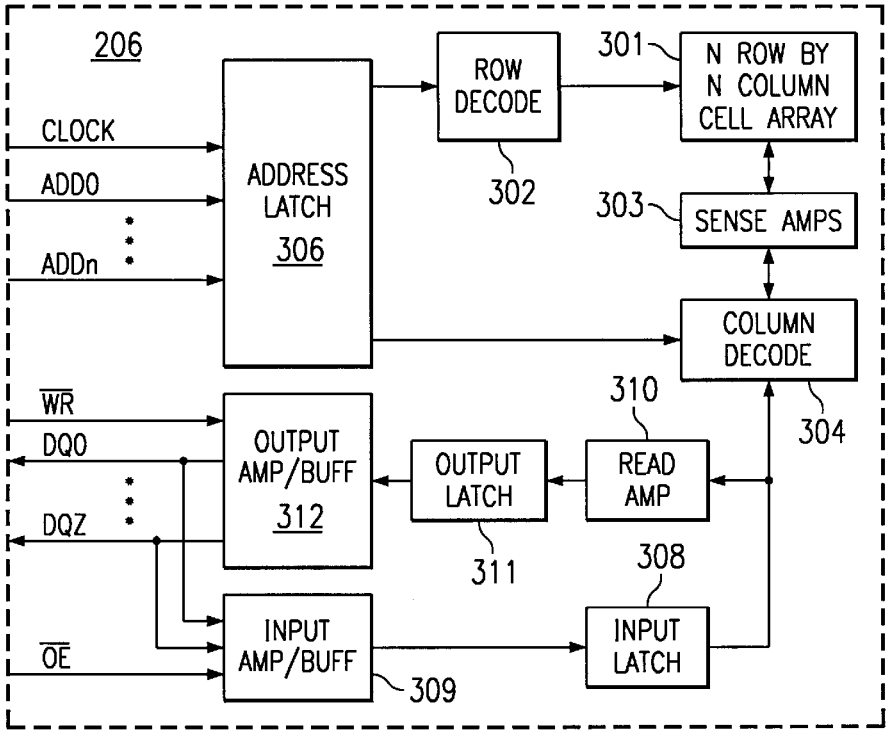
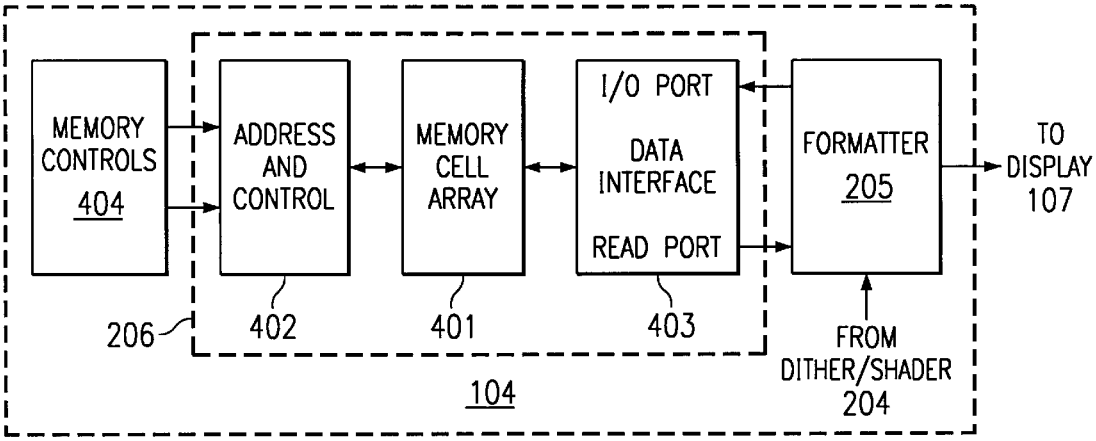
FIG. 4
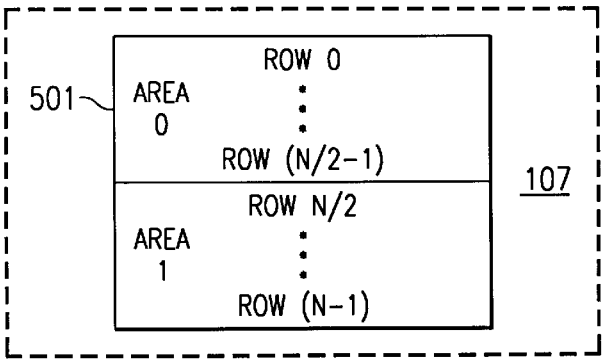
FIG. 5

DISPLAY CONTROLLER WITH INTEGRATED HALF FRAME BUFFER AND SYSTEMS AND METHODS USING THE SAME

TECHNICAL FIELD OF THE INVENTION

The present invention relates in general to electronic display data processing and in particular to a display controller with integrated half frame buffer and systems and methods using the same.

BACKGROUND OF THE INVENTION

Super twisted pneumatic (STN) liquid crystal displays are passive matrix LCD displays which are substantially less expensive to produce than comparably sized active matrix LCD displays, such as thin film transistor (TFT) LCD displays. As a result, STN displays have significant appeal to the makers of low and medium priced laptop and notebook personal computers. Unfortunately, while STN displays provide substantial cost advantages, they do present unique operational problems which must be accounted for during display data processing.

One of the most significant problems with STN displays is the short data retention time of the display elements. Consequently, the display elements (pixel) must be refreshed (scanned) at a rate significantly higher than the refresh rate of comparable active matrix LCD display elements in order to insure that the maximum allowable time between refresh is not exceeded. This in turn requires that the associated display processor be capable of streaming display data to the display at a rate high enough to support the higher refresh rate.

Dual scan super twisted pneumatic (DSSTN) displays attempt to handle the problem of short data retention time by dividing the display screen into two simultaneously scanned regions or areas. During the refresh of each frame, one area is refreshed with current data from the primary frame buffer space while the other area is refreshed with data recycled from the last scan of that area, as retrieved from an independent buffer space in the frame buffer memory. On the next refresh cycle, the first panel is refreshed with recycled data from the independent buffer during the previous scan and the second panel is refreshed with current data from the frame buffer. In other words, display data for a given panel is used twice.

The dual scan-dual buffering scheme advantageously allows the display processor to meet the minimum refresh data requirements of STN displays. However, such a scheme also has substantial disadvantages. Among other things, the demands on the frame buffer system are significantly increased. Specifically, three different types of operations are required for display refresh alone. First, reads are required from the primary frame buffer space to support refresh of the screen area being refreshed with current data. Second, reads are required from the independent buffer space to support refresh of the area being refreshed with recycled data. Finally, writes of the current data into the independent buffer space are required to store data for recycling during the next refresh cycle. All these operations must be performed in view of all the other demands made on the frame buffer memory subsystem by the CPU and display controller. Among other things, the frame buffer must also provide for CPU access for data updates, bit-block transfers (BLTs), cursor generation, and allow the display controller to perform such operations as basic graphics functions and DRAM refresh.

An additional problem arises since the buffering of the data being recycled requires additional capacity in the frame buffer. The dynamic random access memories (DRAMs) most often used to construct frame buffers are only manufactured in fixed capacities and fixed word widths. Consequently, the capacity of memory subsystems supporting a given data bus width can typically be varied only in corresponding fixed incrementations. Thus, depending on the capacity already required to support traditional frame buffer operations and the size of the memory devices used, the additional storage capacity required for recycling may force the use of the next largest incrementation of memory. The next incrementation however may have substantially more capacity than required to meet both the needs of the traditional and the additional frame buffers. As a result, memory space is wasted and unnecessary costs incurred.

Thus, the need has arisen for circuits, systems and methods for implementing dual scan displays. In particular, such circuits, systems and methods should reduce frame buffer subsystem overhead and reduce wasted memory space and the associated costs.

SUMMARY OF THE INVENTION

According to a first embodiment of the principles of the present invention, a display controller is provided for use with a display device operable to display images on a screen. The display controller includes circuitry for presenting first data to the display device for generating an image in a first area of the screen, the first data being retrieved from an external frame buffer. The display controller also includes circuitry for a presenting second data to the display device for generating an image in a second area of the screen, the second data being retrieved from an internal frame buffer.

According to a second embodiment of the principles of the present invention, an integrated circuit is provided which includes an integrated partial frame buffer. An integrated circuit also includes first circuity operable during a first screen refresh cycle to process first data for generating images in a first screen area of a multiple scan display, the first data received from an external source. The integrated circuit further includes second circuitry operable during the first screen refresh cycle to process second data to process images in a second screen area of the multiple scan display, the second data retrieved from the partial frame buffer. Additionally, third circuitry is provided as part of the integrated circuit operable during the first refresh cycle to store the first data in the frame buffer during the first refresh cycle.

According to a further embodiment of the first invention, an integrated circuit fabricated on a single chip is provided which includes a display controller and a half frame buffer.

Principles of the present invention also apply to systems. In one such system, a display device is provided for displaying images on at least two independently scanned screen areas. The system also includes a frame buffer and an integrated circuit comprising a display controller and an internal half frame buffer.

The principles of the present invention are additionally embodied in methods for displaying data. According to one method embodying the principles of the present invention, a method of displaying data on a screen of a display device is provided. During a screen refresh cycle, first data is presented to the display device for generating an image in a first area of the screen, the first data being retrieved from an external frame buffer. During the same screen refresh cycle, second data is presented to the display device for generating an image in a second area the screen, the second data being retrieved from an internal frame buffer.

The principles of the present invention have substantial advantages over the prior art. In particular, these principles are particularly advantageous for use in constructing display controllers and associated control circuitry for driving dual scan super twisted pneumatic displays. In particular, circuit systems and methods embodying the present invention reduce frame buffers subsystem overhead and reduce wasted memory and the associated costs.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 3 is a more detailed functional block diagram of the integrated half frame buffer shown in FIG. 2;

FIG. 4 is a functional block diagram of a second display controller embodying the principles of the present invention; and FIG. 5 is a general depiction of a display screen under control of a display controller according to the principles of the present invention.

DETAILED DESCRIPTION OF THE INVENTION

The principles of the present invention and their advantages are best understood by referring to the illustrated embodiment depicted in FIGS. 1–4 of the drawings, in which like numbers designate like parts. While the principles of the present invention may be applied to a wide number of systems, for purposes of illustration, these principles will be described in conjunction with a basic processing system architecture typically employed in personal computers.

Figure 1:
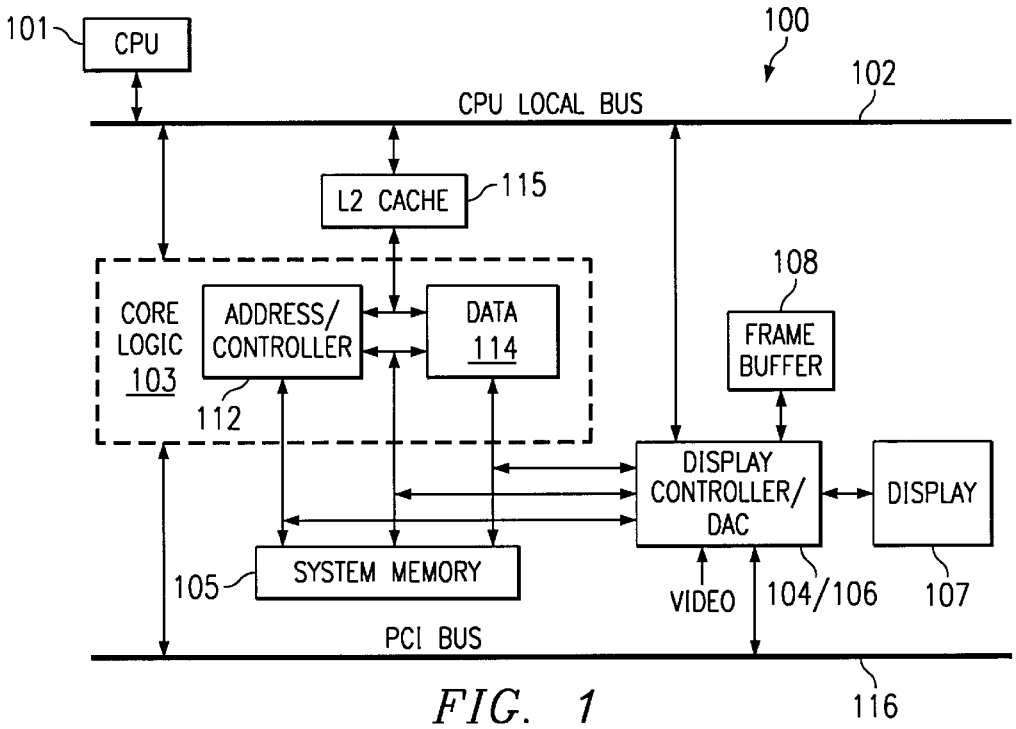
FIG. 1 is a high level functional block diagram of a processing system embodying the principles of the present invention.

FIG. 1 is a high level functional block diagram of portion of a processing system 100. System 100 includes a central processing unit 101, a CPU local bus 102, core logic 103, a display controller 104, a system memory 105, a digital to analog converter (DAC) 106, frame buffer 108, a display device 107 and peripheral bus 116. As discussed further below, according to the principles of the present invention, display controller 104 includes an integrated half-frame buffer for controlling a display device 107 which includes a dual scan super twisted pneumatic (DSSTN) display.

CPU 101 is the "master" which controls the overall operation of system 100. Among other things, CPU 101 performs various data processing functions and determines the content of the graphics data to be displayed on display unit 107 in response to user commands and/or the execution of application software. CPU 101 may be for example a general purpose microprocessor, such as an Intel PENTIUM™ class microprocessor or the like, used in commercial personal computers. CPU 101 communicates with the remainder of system 100 via CPU local bus 102 and a peripheral bus 116. CPU local bus 102 may be for example a special bus, or a general bus, as known in the art. Peripheral bus 116 is preferably a PCI bus, but may alternatively be any one of a number of other buses known in the art.

Core logic 103, under the direction of CPU 101, controls the exchange of data, addresses, control signals and instructions between CPU 101, display controller 104, and system memory 105. Core logic 103 may be any one of a number of commercially available core logic chip sets designed for compatibility with the remainder of the system, and in particular with CPU 101. One or more core logic chips, such as chip 112 in the illustrated system, are typically "address and system controller intensive" while one or more core logic chips, such as chip 114 in FIG. 1, are "data intensive." Address intensive core logic chip 112 generally: interfaces CPU 101 with the address path of CPU bus 102; maintains cache memory, including the cache tags, set associative cache tags and other data necessary to insure cache coherency; performs cache "bus snooping"; generates the control signals required for DRAMs in the system memory or cache; and controls general management transactions. Data intensive chip 114 generally: interfaces CPU 101 with the data path of CPU local bus 102, and/or peripheral (PCI) bus 116 issues cycle completion responses to address chip 112 or CPU 101; may abort operations if their cycles are incomplete; and arbitrates for the data path of CPU local bus 102 and/or peripheral (PCI bus 116).

CPU 101 can directly communicate with core logic 103 or through an external (L2) cache 115. L2 cache 115 may be for example a 256 K Byte fast SPAM device(s). It should be noted that CPU 101 can also include on-board (L1) cache, typically up to 16 kilobytes.

Display controller 104 may be any one of a number of commercially available VGA display controllers modified as required to implement an integrated half-frame buffer described below in conjunction FIG. 2. For example, display controller 104 may generally be one of the Cirrus Logic CL-GD754x series of display controllers. The structure and operation of such controllers is described in *CL-GD754x Application Book*, Rev 1.0, Nov. 22, 1994, and *CL-GD7542 LCD VGA Controller Preliminary Data Book*, Rev. 1.0.2, June 1994, both available from Cirrus Logic, Inc., Fremont, Calif., and incorporated herein by reference.

Display controller 104 may receive data, instructions and/or addresses from CPU 101 through core logic 103. Data, instructions, and addresses are also exchanged between display controller 104 and system memory 105 through core logic 103. Further, addresses and instructions may be exchanged between core logic 103 and display controller 104 via a peripheral (local) bus 116 which may be for example a PCI local bus.

Generally, display controller 104 controls screen refresh, executes a limited number of graphics functions such as line draws, polygon fills, color space conversion, display data interpolation and zooming, and video streaming, and handles other ministerial chores such as power management. Most importantly, display controller 104 controls the raster of pixel data from frame buffer 108 to display unit 107 during screen refresh and interfaces CPU 101 and frame buffer 108 during display data update. Video data may be directly input into display controller 104.

Digital to analog converter 106 receives digital data from controller 104 and outputs the analog data to drive display 107, as required. In the illustrated embodiment, DAC 106 is integrated with display controller 104 onto a single chip.

Depending on the specific implementation of system 100, the display controller 104 may also include a color palette, YUV to RGB format conversion circuitry, and/or X- and Y-zooming circuitry, to name a few options.

Display 107 is preferably a dual scan super twisted pneumatic (DSSTN) display which displays images as a plurality of pixels on a panel divided into two simultaneously scanned panels areas. It should be noted however that the principles of the present invention are not limited to dual scan STN displays but may be employed in multiple scan STN displays divided into multiple independently scanned display ares or regions. For example, the display screen may be divided into four simultaneously scanned regions.

Figure 2:
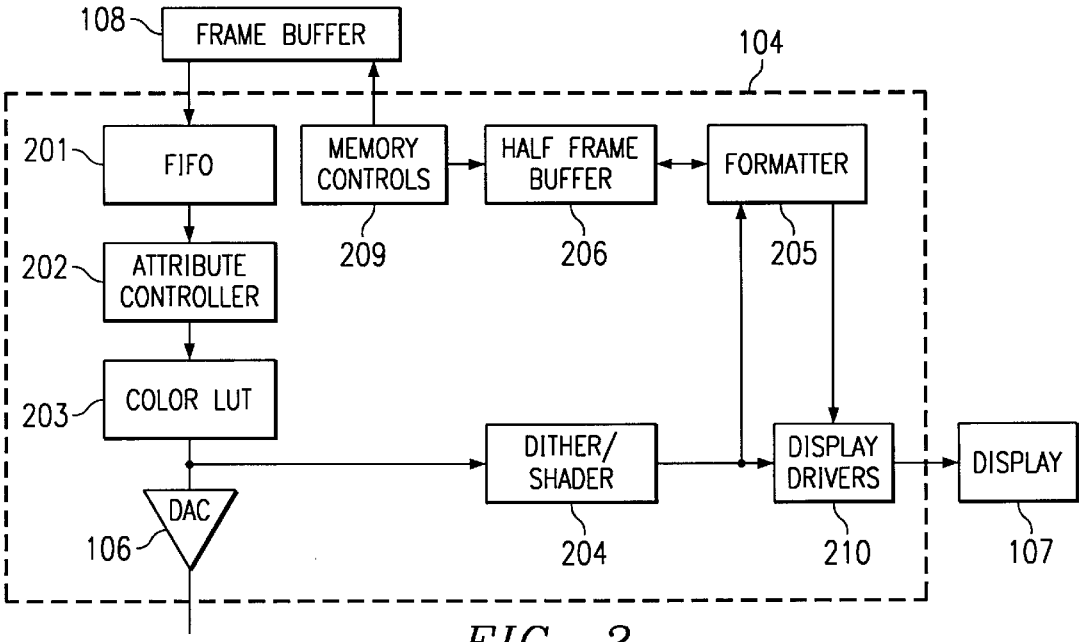
FIG. 2 is a more detailed functional block diagram of a portion of the display controller of FIG. 1 and its interface with the associated display device and frame buffer.

FIG. 2 is a more detailed functional block diagram emphasizing the circuitry of display controller 104 with a half-frame buffer integrated on the same semiconductor chip controlling the processing and pipelining of data to display 107 in the illustrated embodiment. It should be recognized that the architecture and circuitry of FIG. 2 are provided to illustrate the application of the present invention; in actual implementation of the principles of the present invention the architecture and circuity of the display controller may vary widely from embodiment to embodiment.

Generally, display data is received from frame buffer 107 through a first-in-first-out (FIFO) memory or register 201. Among other things, FIFO 201 insures that the data stream through display controller 104 remains relatively constant, even when the input data stream from frame buffer 108 is interrupted as other memory operations in frame buffer 108 take place.

The display data pipelined from FIFO 201 is next passed through a conventional attribute controller 202. Attribute controller 202 generally performs operations such as blinking and underlining in text modes. The output of attribute controller 202 in the illustrated embodiment indexes a conventional color look-up table 203.

Digital to analog converter (DAC) 106 is coupled to color look-up table 203 for driving a second display, such as a CRT display. In the illustrated embodiment, DAC 106 is not connected to a second display.

The indexed color data from color look-up table 203 is also sent to a conventional dither/shader circuitry. Dither/shader circuitry 204 generally reduces (compresses) the number of bits of each word of display data, typically to as little as 40% of the input word width. For example, assume that the system is processing 8-bit per pixel display data pipelined from frame buffer 108, dither/shader circuitry may reduce each of those words to a three bit word using algorithms known in the art.

Data for refreshing a selected one of the area on the display screen of DSSTN display 107 is provided to display 107 from dither/shader circuitry 204 through conventional drivers/buffers 210. The same data is also input into a formatter 205 for eventual storage in integrated half frame buffer subsystem 206. Formatter 205 performs such functions as varying the bit-weight of each bit in each word being exchanged with half frame buffer subsystem 206 thereby allowing additional optimization of the required capacity of half frame buffer subsystem 206. Data being recycled from the previous scan of a given display area is read from half frame buffer system 206 and processed by formatter 205 before presentation to DSSTN display unit 107.

Display controller 104 also includes conventional memory controls 209. Among other things, memory controls includes address generators, signal generators for generating memory control signals (e.g. /RAS, /CAS, DE and R/W), and arbitration and/or sequencer circuity for prioritizing and executing access to frame buffer 108 and half frame buffer 206.

Integrated half frame buffer memory subsystem 206 preferably may be organized in a typical semiconductor memory architecture, such as that shown in FIG. 3.

In the architecture of FIG. 3, half frame buffer subsystem 200 includes an array 301 of memory cells arranged in M number of rows and N numbers of columns. Each row is associated with at least one conductive wordline coupled to a row decoder 302 and each physical column of cells is associated with at least one bitline coupled to a corresponding one of sense amplifiers 303. Data is exchanged with the sense amplifiers 303, and consequently the associated columns of cells, through column decoders 304. In the preferred embodiment, row decoder 302, sense amplifiers 303, and column decoder 304 are constructed from dynamic circuitry, although in alternate embodiments, static circuitry also may be used.

According to the principles of the present invention, any one of a number of available memory cell designs can be used to fabricate array 301. For example, 1-transistor 1-capacitor dynamic random access memory (1T1C DRAM) cells of either the P-channel or N-channel type can be used if small cell size and/or higher density arrays are required. Alternatively, (3T) DRAM cells may be used, preferably constructed using an ASIC process. If a faster memory array is desire, static random access memory (SRAM) cells may be used. For example, the cells of array 301 may be 4-transistor 2-resistor (4T2R)or 6-transistor (6T) SRAM cells.

Addresses to row decoder 302 and column decoder 304 are pipelined through a address latch from conventional address generation circuitry within memory controls 209. Data is output (read) from array 301 through a read amplifier 310, output latch 311 and output amplifier/buffer 312. Data is input (written) into array 301 through a data latch 308.

According to an alternate embodiment of the principles of the present invention, half frame buffer subsystem 206 may be constructed as a dual-port memory. An illustrative dual-ported architecture is shown in FIG. 4. In this case, data is written into the cell array from formatter 205 through an conventional I/O (bidirectional) port and data is read out to formatter 205 through a second (read) independent port. The dual-port embodiment is preferably constructed with SRAM cells, although DRAM cells could alternatively be used.

TABLE I

| DISPLAY SIZE | PIXEL* DEPTH | FRAME BUFFER 108 MINIMUM CAPACITY | HALF FRAME** BUFFER 206 MINIMUM CAPACITY | TOTAL*** MEMORY CAPACITY |
|---|---|---|---|---|
| 640 × 480 | 4 BPP | 150 kByte | 57 kByte | 1 MByte |
| 640 × 480 | 8 BPP | 300 kByte | 57 kByte | 1 MByte |

TABLE I-continued

| DISPLAY SIZE | PIXEL* DEPTH | FRAME BUFFER 108 MINIMUM CAPACITY | HALF FRAME** BUFFER 206 MINIMUM CAPACITY | TOTAL*** MEMORY CAPACITY |
|---|---|---|---|---|
| 640 × 480 | 16 BPP | 600 kByte | 57 kByte | 1 MByte |
| 640 × 480 | 24 BPP | 900 kByte | 57 kByte | 2 MByte |
| 800 × 600 | 4 BPP | 235 kByte | 88 kByte | 1 MByte |
| 800 × 600 | 8 BPP | 470 kByte | 88 kByte | 1 MByte |
| 800 × 600 | 16 BPP | 940 kByte | 88 kByte | 2 MByte |
| 800 × 600 | 24 BPP | 1.4 MByte | 88 kByte | 2 MByte |
| 1024 × 768 | 4 BPP | 384 kByte | 144 kByte | 1 MByte |
| 1024 × 768 | 8 BPP | 768 kByte | 144 kByte | 1 MByte |
| 1024 × 768 | 16 BPP | 1.5 MByte | 144 kByte | 2 MByte |
| 1024 × 768 | 24 BPP | 2.3 MByte | 144 kByte | 2 MByte |

*BPP = BITS PER PIXEL
**HALF FRAME BUFFER CAPACITY ASSUMES DATA FORMATTED/COMPRESSED TO 3 BITS PER PIXEL.
***INCLUDE OFF-SCREEN, HARDWARE CURSOR, AND ICON STORAGE.

TABLE I summarizes the required frame buffer and half frame buffer capacities for selected display sizes and pixel depths. Advantageously, with the integrated half frame buffer of the present invention, the number instances where substantial amounts of memory is wasted is reduced. For example, a 800 by 600 pixel display with a pixel depth of 16 bits per pixel requires a traditional frame buffer of 940 kBytes and a half frame buffer of 88 Kbytes for recycling. With the present invention, a standard memory incrementation 1 Mbyte may be used to construct frame buffer 108, with the 88 kByte half frame buffer provided on-chip. To support a DSSTN display system using only an external frame buffer would require a minimum capacity of 940 kBytes plus 88 kBytes for buffering, or a total 1028 kBytes (not even considering required space for icons and off-screen memory). Assuming that conventional memory devices are used, the next memory incrementation of 2 Mbytes must be chosen with the result being substantial wasted memory space. Similar advantages from the application of the principles of the present invention are also found, for example, in the case of 640 by 480 by 24. Considering the added storage requirement of video, this memory saving becomes more important.

The display control operations of system 100 can now be described in reference to FIG. 5, which is stylized view of the screen 501 of display device 107. In the illustrated embodiment, screen 501 is comprised of a plurality of rows of super twisted pneumatic LCD display elements (pixels) partitioned into two independently scanned areas or regions, with Rows 0 to (N/2−1) forming AREA 0 and Rows N/2 to (N−1) forming AREA 1.

The raster scan for AREA 0 begins with the first pixel in Row 0 (i.e the upper left hand corner). At the same time, the raster scan for AREA 1 begins with the first pixel in Row N/2. Assume for discussion purposes, that during a first refresh (scan) cycle AREA 0 is refreshed with data from external frame buffer and AREA 1 is refreshed with data from the integrated half-frame buffer 206.

As each word of data from the frame buffer 108 is output from dither/shader circuitry 204 and sent to display 107 to support the current raster scan of AREA 0, it is also sent to formatter 205. Using conventional arbitration and pipelining techniques, the formatted data from dither/shader 204 is written into memory and recycled data stored during the previous refresh of AREA 1 read to support the raster scan of AREA 1.

During the subsequent refresh (scan) cycle, data from frame buffer 108 supports the raster scan of AREA 1 and is written into half-frame buffer subsystem 206. The data stored in half-frame buffer subsystem 206 during the previous cycle is now read out to support the raster scan of AREA 0.

This two-step process is repeated as long as the display screen 301 of display 107 is active. In sum, for a dual scan display, such as a DSSTN display, the data from external frame buffer 108 is used twice for a given scan area: during a first raster scan as directly retrieved and processed from frame buffer 108 and on the subsequent raster scan after buffering in half frame buffer subsystem 206. Further, during one refresh cycle a first panel is refreshed with data from frame buffer 108 and a second panel refreshed with data from half frame buffer subsystem 206. On the next refresh cycle, the first panel is refreshed from the half frame buffer subsystem 206 and the second from frame buffer 108.

Display processors having integrated half frame buffers according to the principles of the present invention. Among other things, the demands on the traditional (external) frame buffer 108 are substantially reduced. Additionally, by integrating the half frame buffer with the display controller, the capacity of the external frame buffer can be reduced and/or its use optimized.

Although the present invention and its advantages have been described in detail, it should be understood that various changes, substitutions and alterations can be made herein without departing from the spirit and scope of the invention as defined by the appended claims.

What is claimed is:

1. An integrated circuit comprising:

a partial frame buffer;

first circuitry operable during a first refresh cycle to process first data for generating images in a first screen area of a multiple scan display, said first data received from an external source;

second circuitry operable during said first refresh cycle to process second data for generating images in a second screen area of the multiple scan display, said second data retrieved from said partial frame buffer; and third circuitry operable during said first refresh cycle to store said first data in said frame buffer during said first refresh cycle wherein the first circuitry comprises dither/shader circuitry.

2. The integrated circuit of claim 1 wherein said second circuitry comprises a dither/shader and a formatter.

3. An integrated circuit comprising:

a partial frame buffer;

first circuitry operable during a first refresh cycle to process first data for generating images in a first screen area of a multiple scan display, said first data received from an external source;

second circuitry operable during said first refresh cycle to process second data for generating images in a second screen area of the multiple scan display, said second data retrieved from said partial frame buffer; and third circuitry operable during said first refresh cycle to store said first data in said frame buffer during said first refresh cycle wherein the first circuitry comprises dither/shader circuitry and wherein said second circuitry comprises a dither/shader and a formatter.

* * * * *